United States Patent [19]

Pickrell

[11] 4,128,182

[45] Dec. 5, 1978

[54] TRASH COLLECTING AND HANDLING VEHICLE

[76] Inventor: John W. Pickrell, 4206 N. 68th St., Scottsdale, Ariz. 85251

[21] Appl. No.: 857,207

[22] Filed: Dec. 5, 1977

Related U.S. Application Data

[63] Continuation of Ser. No. 710,654, Aug. 2, 1976, abandoned.

[51] Int. Cl.[2] ..... B65F 3/02

[52] U.S. Cl. ..... 214/302; 214/313

[58] Field of Search ..... 214/302, 303, 313, 78; 180/66 R, 51, 44 F; 60/468, 480

[56] References Cited

U.S. PATENT DOCUMENTS

| | | | |
|---|---|---|---|
| 2,020,231 | 11/1935 | Bell | 214/302 |
| 3,342,282 | 9/1967 | Forphal | 180/66 R |
| 3,521,720 | 7/1970 | Korotkin | 180/66 R |
| 3,641,765 | 2/1972 | Hancock et al. | 180/44 F |
| 3,765,554 | 10/1973 | Morrison | 214/302 |
| 3,912,033 | 10/1975 | Ancel | 180/66 R |

*Primary Examiner*—Lawrence J. Oresky
*Attorney, Agent, or Firm*—Dean, Flickinger & Robertson

[57] ABSTRACT

The disclosure relates to a very compact, highly maneuverable, trash collecting and handling vehicle having forward and rearward portions steerably connected together about a vertical pivotal axis located between the front and rear wheels; the front and rear wheels being driven hydraulically through a pair of differentials which are powered by hydraulic motors driven by a pair of respective hydraulic pumps which are variable delivery and reversable wobble plate controlled piston type pumps; and wherein a manual control variably increases flow from said pumps to motors when said manual control is moved in one direction and whereby, when said manual control is moved in an opposite direction, the opposite functions occur with relation to the pumps and hydraulic motors. The disclosure also relates to trash container pickup means and operator control means on the forward portion of the vehicle and a trash receiver carried by the rearward portion of the vehicle. Additionally, the vehicle is provided with a pivotal connection between the front wheels and the rear wheels; such pivotal connection being disposed on a substantially horizontal fore and aft axis so that the axes of the front wheels may be disposed angularly relative to the axes of the rear wheels in order that the vehicle may be efficiently driven over uneven ground while maintaining efficient traction of the wheels thereon.

15 Claims, 11 Drawing Figures

22
182
184
186
190
188
20
210
212
194
192
10
6
12
8
18
14
16
40
44
42
46
26
24
28
30
4
5
6

28
30
26
24
34
38
44
68
70
90
92
94
96
98
100
102
104
106
108
110
112
114
116
118
120
122
124
126
128
130
134
136
138
140
142
144
146
148
150
152
154
156
158
166
168
170
172
174
176
180
190
191
193

TRASH COLLECTING AND HANDLING VEHICLE

This application is a continuation of the application of John W. Pickrell, Ser. No. 710,654, filed Aug. 2, 1976 for Trash Collecting and Handling Vehicle, now abandoned.

Other related applications are Ser. No. 857,207, filed Dec. 5, 1977; and Ser. No. 770,398, filed Feb. 22, 1977, and in which a Notice of Allowance issued Apr. 13, 1978.

BACKGROUND OF THE INVENTION

Various trash collecting vehicles have been used for the purpose of collecting trash from municipal areas and, in most instances, the collection of trash in such areas, where small trash containers are used, involves manual labor for the purpose of dumping the trash from the small containers into a receiver on the trash collecting vehicle. The foregoing conditions have prevailed due to the fact that most trash collecting vehicles are not readily and quickly maneuverable in close quarters, such as to provide for mechanical handling of the small trash containers such as may be placed in alley ways or other narrow or restricted or obstructed areas, and especially in areas where such containers may be disposed in random positions and difficult to approach.

Accordingly, it has heretofore been costly and time consuming for the operator of a trash collecting vehicle and at least two ground workers to collect trash from small containers and transfer such trash into a large receiver carried by the vehicle.

SUMMARY OF THE INVENTION

The present invention relates to a highly maneuverable and very compact trash collecting vehicle which is capable of working in narrow alley ways and restricted areas where small trash containers are disposed at random and in groups and on oposite sides of such an alley way, and wherein great maneuverability and short radius turns are required for mechanical pickup of the containers under such conditions. The invention also relates to a vehicle of the aforementioned class which is very quickly moveable in a forward or alternately in a rearward direction by hydraulic drive and control means which cooperates with articulated steering of the chasis and also with the pivotal connection of the forward and rearward portions of the chasis about a substantially horizontal fore and aft axis. The vehicle being a four wheel drive vehicle capable of maximum traction in alley ways, wherein conditions may be difficult following a rain storm or the like; the vehicle being provided with a short wheel base and having a manual control means on the forward portion thereof together with a container grasping and pickup means carried on the forward portion of the vehicle and the rearward portion of the vehicle is provided with means for carrying a removeable trash receiver which may readily be handled by a larger trash pickup vehicle after it has been filled and removed from the rearward portion of the vehicle of the present invention.

The vehicle of the invention is provided with a novel drive means in combination with articulated steering and the pivotal connection of the forward and rearward portions of the vehicle on a fore and aft horizontal axis. The aforementioned drive means includes an engine which drives a pair of hydraulic pumps having reverseable and variable delivery wobble plate mechanism therein; the two pumps being controlled by a common foot control, which is moveable in either of two directions to concurrently increase the respective volumetric fluid delivery of the pumps and thus, when the foot control is moved in opposite directions, it is adapted to cause alternate forward and reverse operation of the pumps and the respective pumps are adapted to deliver hydraulic fluid to individual hydraulic motors connected with differential drives, which individually drive the front wheels of the vehicle and the rear wheels thereof in both forward and reverse directions.

Accordingly, the manual foot control of the invention permits the operator to press forward on the foot control pedal and cause the vehicle to move in a forward direction and, as the foot control pedal is pressed further forward, the vehicle moves more rapidly. Additionally, the foot control may be moved or tilted backwardly such that the vehicle will move in reverse and at a variable speed depending upon the degree of backward movement of the control pedal.

Accordingly, the vehicle of the invention is very quickly shifted from forward to reverse operation and is very quickly moved from low speed to high speed depending upon the degree of forward or rearward movement of the foot control pedal for controlling the vehicle in either direction.

The aforementioned control, coupled with articulated steering and four wheel drive capabilities, renders the vehicle very fast and very maneuverable in both forward and reverse operations and in close quarters where a short turning radius is required in both lefthand and righthand directions. Such as in an alley way where various trash containers are disposed in random position at opposite sides of the alley way so that the operator may alternately move quickly from one side of the alley way to the other and readily grasp and empty containers into the receiver on the vehicle.

The invention also comprises novel bleed flow conduit means adapted to hydraulically compensate for varying sizes of wheels and tires on the front and rear of the four wheel drive vehicle; and the aforementioned bleed flow means being sufficient to accomplish such functions without unduly restricting full power output to either the front or rear wheels when traction of either the front or rear wheels is lost due to poor terrain conditions.

With the aforementioned agility of the vehicle of the invention, a container pickup and grasping means is mounted on the forward portion of the vehicle adjacent to the operator's compartment thereon. This mechanism is adapted to pick up individual trash containers and move them upward and backward into an upside-down position over a trash receiver carried on the rearward portion of the vehicle, all of which provides for an extremely agile, fast and compact vehicle, highly maneuverable in close quarters, such as restricted alley ways where trash containers are positioned in random locations at opposite sides thereof.

Accordingly, it is an object of the invention to provide a small compact, highly maneuverable and very fast trash collection vehicle adapted for use in grasping and emptying small trash containers in very rapid and efficient manner.

Another object of the invention is to provide a trash collecting vehicle which is very fast in operation, both in forward and reverse directions, as well as in turning operations due to a novel hydraulic power and control system used in combination with a pair of differentials which individually drive the front and rear wheels of the vehicle which are steerable relative to each other about a vertical axis and are pivoted relative to each other about a fore and aft horizontal axis such that the vehicle is very compact and has extremely good traction with all four wheels operating evenly and with the power applied therefor in a very uniform and efficient manner.

Another object of the invention is to provide a novel and highly maneuverable trash collecting vehicle having a four wheel drive chasis with articulated steering and a novel hydraulic control means which functions to provide forward and rearward operation by simply moving a manual control means in a forward and rearward direction alternately to provide forward and rwarward directional movement of the vehicle at variable speeds, whereby the vehicle may be very quickly moved forward and rearward and whereby the hydraulic system may function as a braking means due to its reverse power operation by a single control which is manually operable by the foot of the operator.

Another object of the invention is to provide a very compact, highly maneuverable and fast four wheel drive trash collecting vehicle wherein a hydraulic drive system drives two hydraulic motors in connection with two differentials which are at the forward and rearward portions of the vehicle, and wherein a novel restricted bleed flow means provides for balanced and compensated operation of the differentials which drive the front and rear wheels of the vehicle respectively whereby the bleed flow conduit means compensates for the circumferential aggregate of the wheels at the rear of the vehicle relative to the circumferential aggregate of the wheels at the front of the vehicle to thereby alleviate any power application differentials and to thus maintain optimum traction while causing a minimum amount of wear on the tires and the drive mechanism.

Further objects and advantages of the invention may be apparent from the following specification, appended claims and accompanying drawings.

DESCRIPTION OF THE PREFERRED EMBODIMENTS

Figures 1, 2, 3:
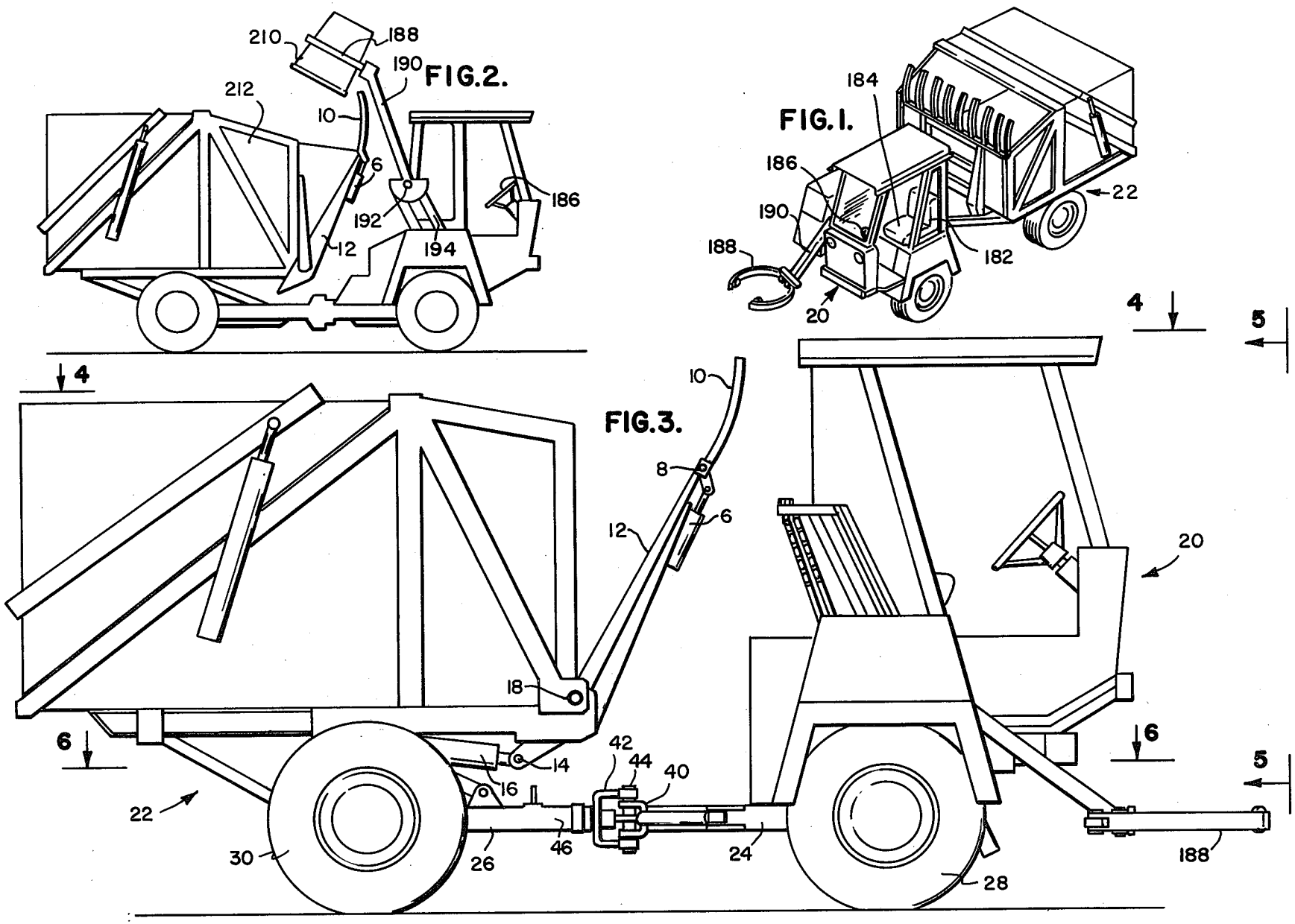
FIG. 1 is a perspective view of the trash collecting and handling vehicle of the invention.
FIG. 2 is a side elevational view thereof showing a varying position of the trash container handling means over the rearward portion of the vehicle.
FIG. 3 is an enlarged side elevational view of the trash collecting and handling vehicle of the invention.

As shown in FIG. 1 of the drawings, the trash collecting vehicle of the invention is provided with a forward portion 20 and a rearward portion 24 carried by forward and rearward frame portions 24 and 26, respectively, which are supported on front wheels 28 and rear wheels 30, respectively.

Figure 6:
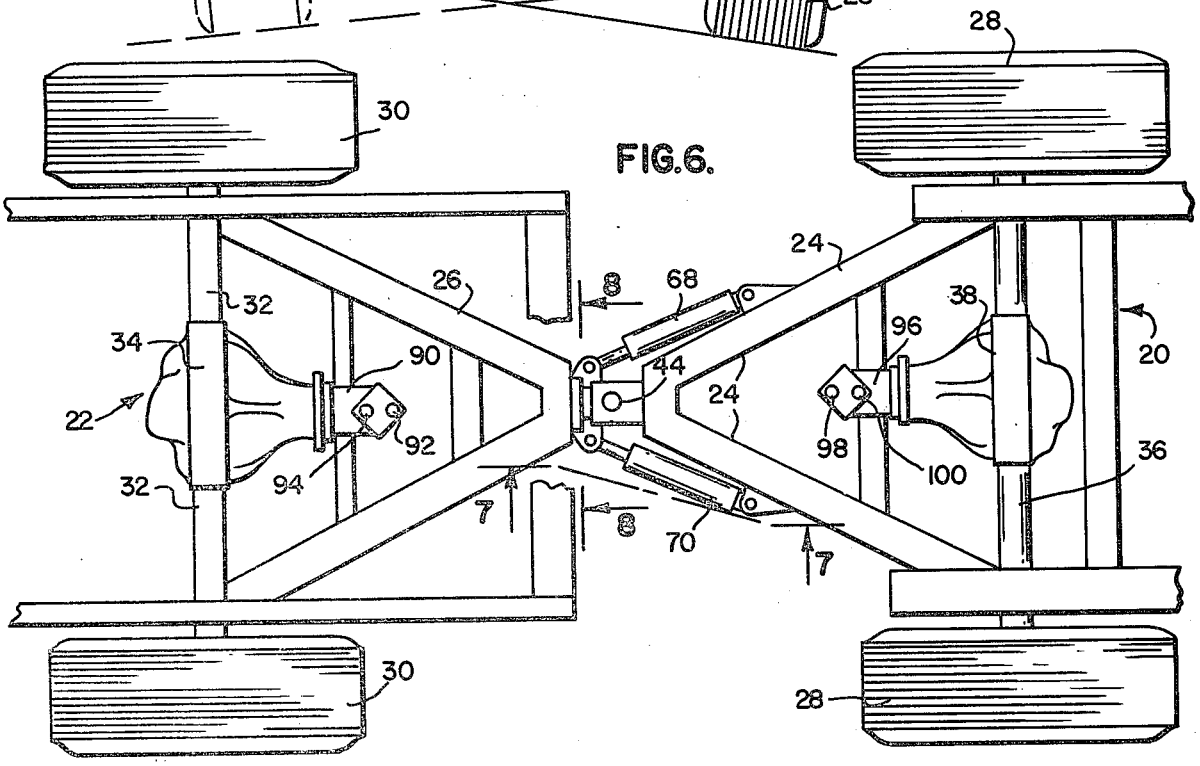
FIG. 6 is a planned sectional view taken from the line 6—6 of FIG. 3 showing the basic chasis of the invention.

As shown best in FIG. 6 of the drawings, the rear wheels are carried by an axle housing 32 having a conventional axle drive differential mechanism 34 adapted to drive axles in the housing 32 which are connected to the wheels 30. The axle housing 32 and differential mechanism 34 are conventionl to automotive vehicles.

Fixed to the axle housing 32 is the rearward frame portion 26. The front wheels 28 are rotatably supported on an axle housing 36 having a differential mechanism 38 which drives the axles in the housing 36 and the axles being connected to the wheels 28 for driving the same. The differential 38 is similar to the differential 34 and connected to the housing 36 is the forward frame portion 24 of the vehicle chasis.

Figure 7:
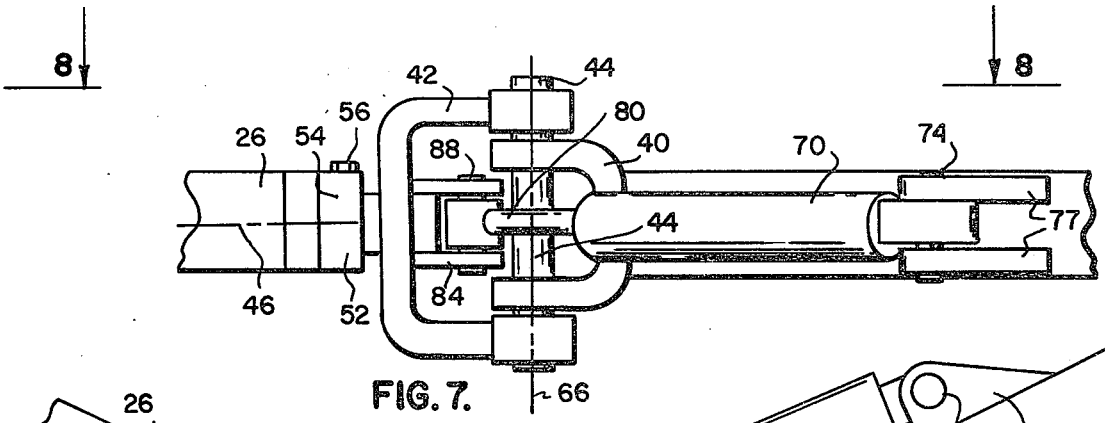
FIG. 7 is a view taken from the line 7—7 of FIG. 6.
Figure 8:
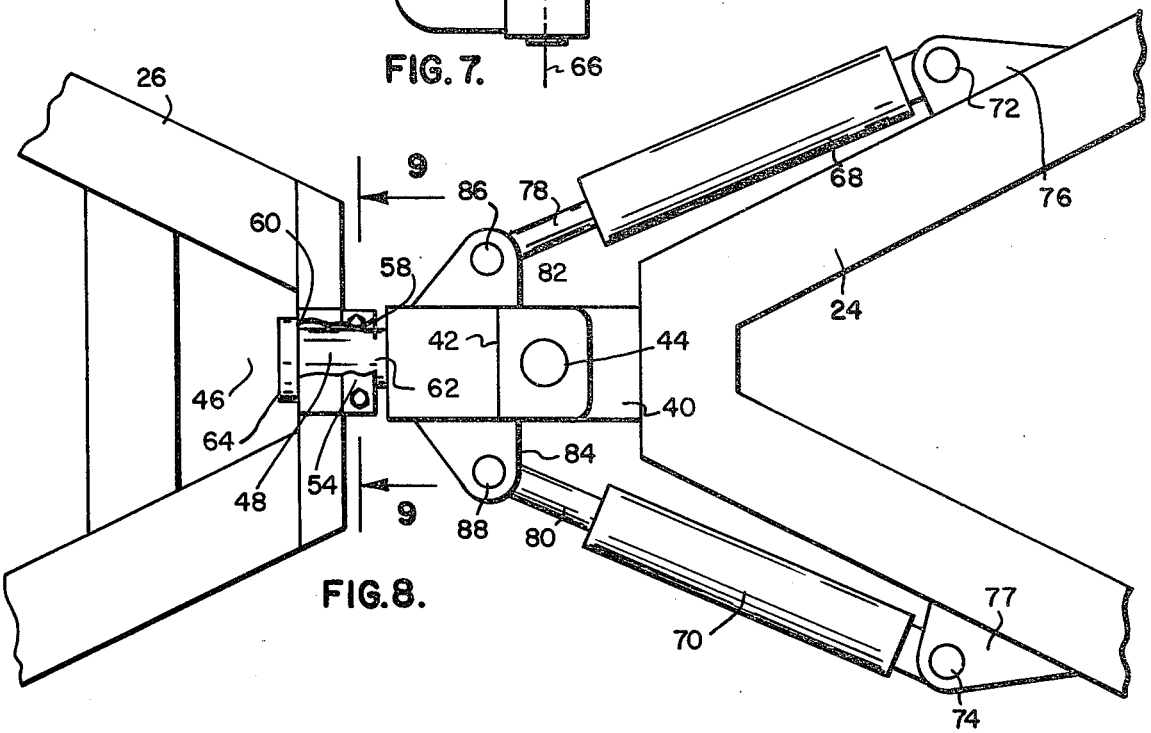
FIG. 8 is a fragmentary plan view taken from the line 8—8 of FIG. 7.
Figure 9:
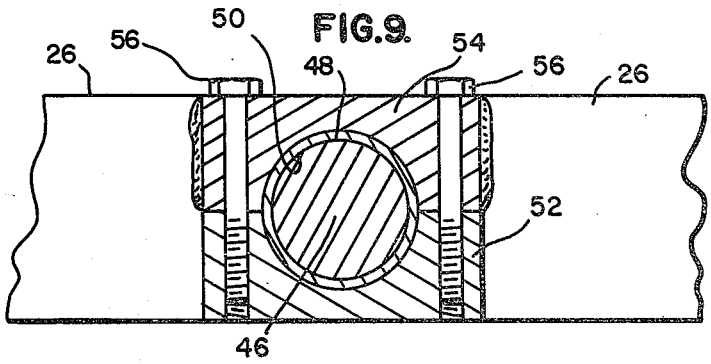
FIG. 9 is an enlarged fragmentary sectional view taken from the line 9—9 of FIG. 7.

As shown in FIGS. 3, 6, 7, 8 and 9, the forward and rearward portions 24 and 26 of the vehicle frame are connected together by a pair of yoke structures 40 and 42; the yoke structure 40 being fixed to the forward frame portion 24 and the yoke 42 is pivotally connected to the yoke 40 by means of a pivot pin 44 having a substantially vertical axis. The yoke 42 as shown in FIGS. 7, 8 and 9 is pivotally connected to the rearward portion 26 of the frame on a fore and aft horizontal axis designated 46 in FIGS. 7 and 8 and also in FIG. 3. The yoke 42 provided with a cylindrical shank 48 supported in a bearing 50 which is secured to the frame portion 26, all as shown best in FIGS. 7, 8 and 9 of the drawings.

A normally lower half of the bearing 50 is designated 52 in FIG. 9 and upper bearing cap 54 is held by means of bolts 56 of the lower portion 52 of the bearing and thus, the cylindrical shank 48 is rotatably held to pivot on the longitudinal horizontal axis 46 which extends in a generally fore and aft direction. It will be seen that a forward portion of the bearing cap 54 is designated 58 and a rearward portion is designated 60. Corresponding shoulders 62 and 64 on the shank 48 rotatably abut the ends or shoulder portions 58 and 60, respectively, so as to provide longitudinal connection of the forward and rearward portions of the frame designated 24 and 26 respectively and thus, allow these portions of the frame to pivot relative to each other about a fore and aft horizontal axis 46 but to limit relative movement of the frame portions 26 and 28 longitudinally of the axis 46.

The forward and rearward portions 24 and 26 of the vehicle frame are pivotal relative to each other about the generally vertical axis 66 of the pin 44 and hydraulic cylinders 68 and 70 are pivotally connected by means of pins 72 and 74 with respective brackets 76 and 77 which are fixed to the forward frame portion 24. The cylinders 68 and 70 are provided with respective extendable and retractable plungers 78 and 80 which are respectively pivoted to brackets 82 and 84 by means of pivot pins 86 and 88. These brackets 82 and 84 are fixed to the steering force between the forward and rearward portions 24 and 26 of the frame about the vertical axis of the pin 44 for pivoting the forward and rearward portions of the vehicle about the axis of the pins 44, all as shown by solid and broken lines in FIG. 4 of the drawings.

Figure 4:
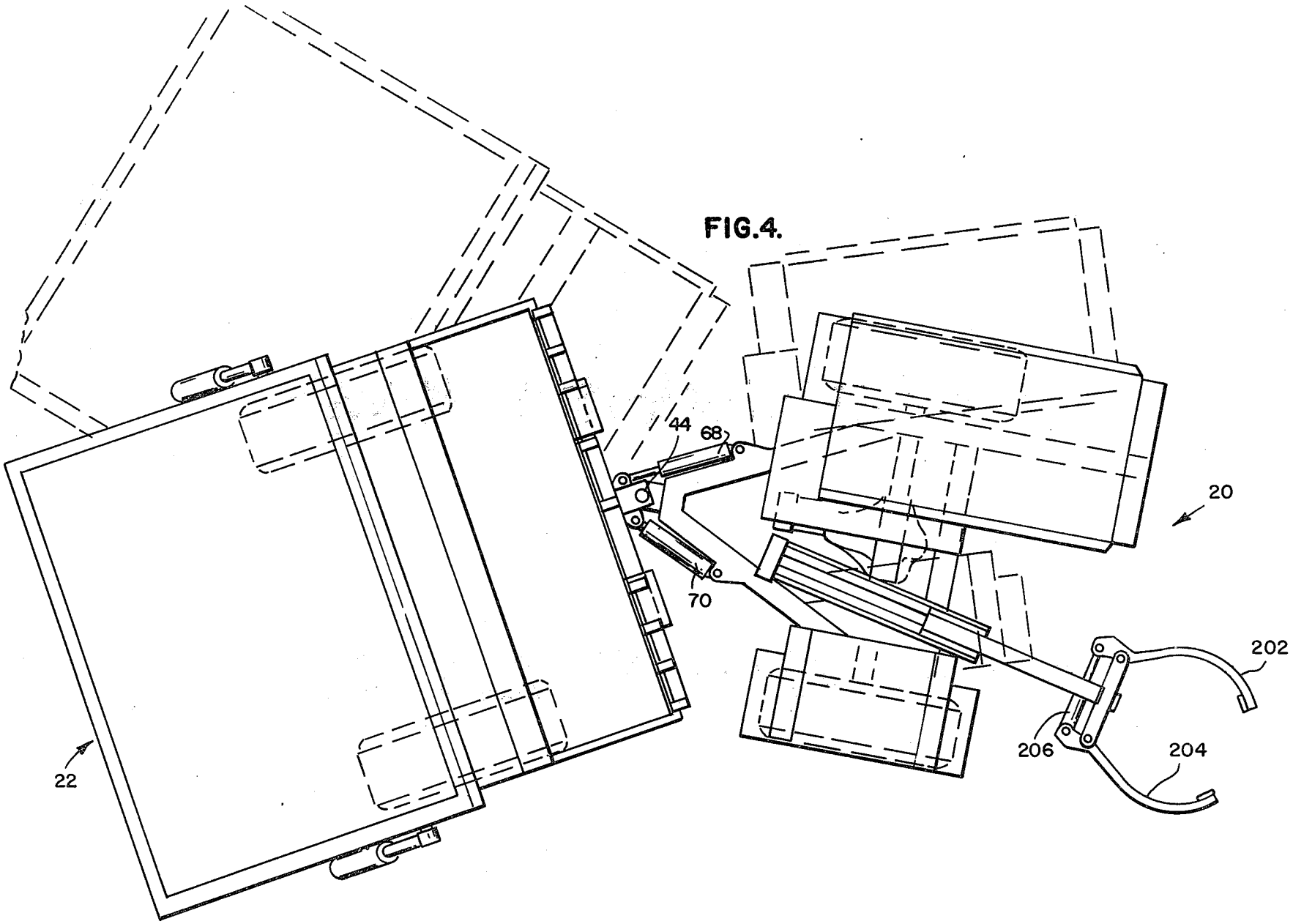
FIG. 4 is a top plan view taken from the line 4—4 of FIG. 3 showing by broken lines variable steering positions of the vehicle of the invention.
Figure 5:
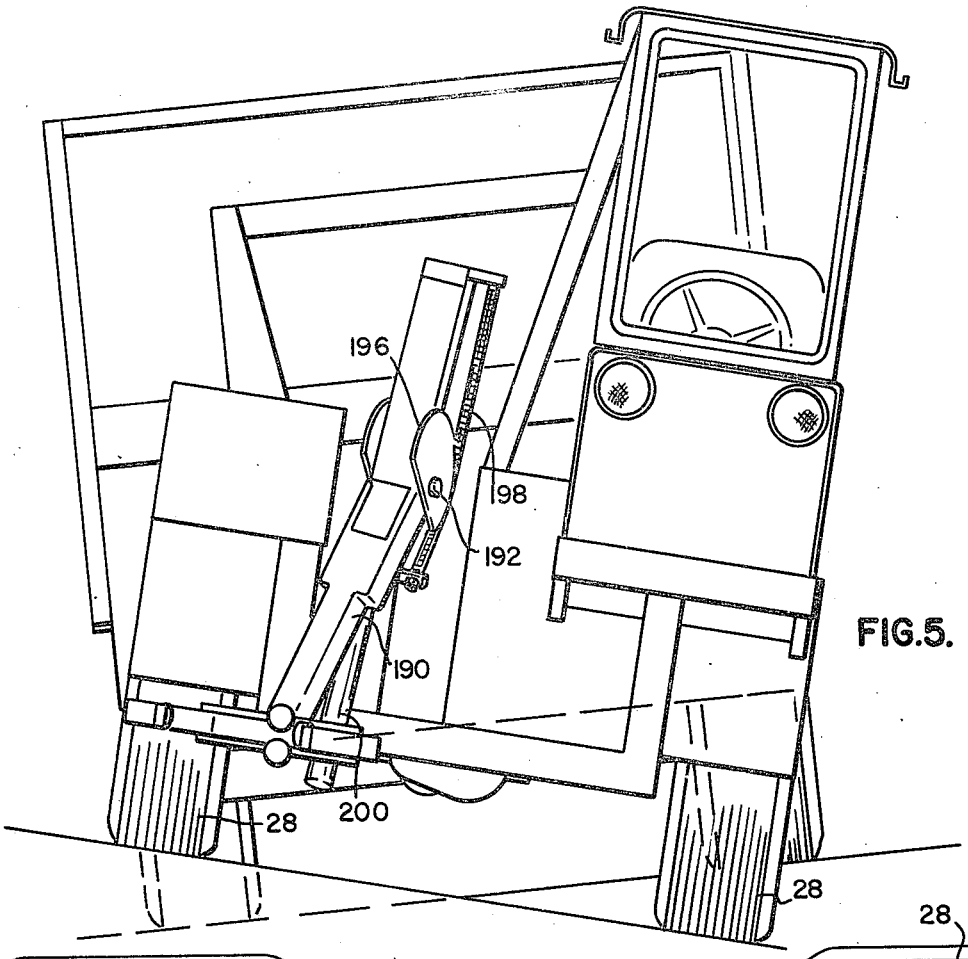
FIG. 5 is a front view of the vehicle taken from the line 5—5 of FIG. 3 showing the vehicle passing over uneven ground and compensating therefore by means of a pivotal bearing means connecting the forward and rearward portions of the vehicle; the pivotal bearing means being on a substantially horizontal fore and aft axis.

In accordance with the foregoing, it will be appreciated that the forward and rearward portions 20 and 22 of the vehicle of the invention are pivotally connected together about a vertical axis 66 of the pin 44 and that these forward and rearward portions 20 and 22 are also pivotally connected together about the horizontal fore and aft axis 46 so that the combined movements as shown in FIGS. 4 and 5 of the drawings may be attained either singly or simultaniously during the manuevering of the vehicle in various areas as may be required and such that the four wheel drive traction may be very efficient due to the fact that all of the wheels may bear evenly on the ground surface.

Drivingly connected to the differential mechanism 34 is a hydraulic motor 90 having a hydraulic fluid inlet conduit means 92 and a hydraulic fluid outlet conduit means 94. Connected to the differential mechanism 38 is another hydraulic motor 96 having a fluid inlet conduit means 98 and a fluid outlet conduit means 100.

Mounted on the forward frame portion 24 of the vehicle is an internal combustion engine 102 which drives a hydraulic pump means 104 having a pair of separate wobble plate operated positive displacement variable delivery and reverseable pumps 106 and 108. This pump means 104 is a Vickers TA-15-15VP. The pump means is provided with a driven shaft 110 which is driven by the engine 102 and this shaft 110 drives the pump means 106 and 108; the pump means 106 having a control shaft 112 and the pump means 108 having a control shaft 114. These shafts 112 and 114 actuate conventional sobble plate control means which actuates positive displacement piston type pump mechanism. This entire pump means 104 is a conventional pump mechanism.

The pump 106 is provided with a pressure fluid delivery conduit means 116 which delivers fluid through a conduit 118 to the pressure fluid inlet 92 of the motor 90 and the pump 106 is also provided with a hydraulic fluid return conduit 120 communicating with a conduit 122 which communicates with the hydraulic fluid return conduit means of the motor 90. Likewise, the pump 108 is provided with a hydraulic pressure fluid delivery conduit means 124 communicating through a conduit 126 with the pressure fluid inlet 100 of the motor 96.

A bleed flow conduit means 132 communicates with the pressure fluid delivery conduit 116 of the pump 106 and the pressure fluid delivery conduit 124 of the pump 108 and this bleed flow conduit is provided with a restricted passage 134. Communicating with the return fluid delivery conduit 120 is a bleed flow conduit 136 which also communicates with the hydraulic fluid return conduit means 128 of the pump 108 and this conduit means 136 is provided with a restricted passage means 138.

The bleed flow restricted passage means 134 and 138 provide for the bleed flow of a small amount of hydraulic fluid between the delivery conduit 116 of the pump 106 and the delivery conduit 128 of the pump 108. Likewise, the bleed flow conduit 132 provides a limited amount of bleed flow between the return conduit 124 of the pump 108 and the return fluid conduit 120 of the pump 106. Accordingly, the small amount of bleed flow equalizes traction of the front wheels 28 relative to the traction of the rear wheels 30 during maneuvering of the vehicle and even though the tire sizes may vary such that the total circumferential aggregate of the tires 28 may vary relative to the circumferential aggregate of the tires 30. The bleed flow capacity of the restricted passages or orifices 134 and 138 are nominal and thus do not interfere with full power operation of the vehicle such that when full volume delivery of either of the pumps is demanded during the loss of traction of either of the wheels 28 and 30. Thus, it is possible to apply full power to the front wheels 28 even though the rear wheels 30 slip or vice versa due to the fact that the nominal bleed flow through the orifices 134 and 138 does not drop the delivery pressure below that required for full power operation of the wheels connected to either the differential 34 or the differential 38.

Accordingly, the bleed orifices 134 and 138 compensate for variations in tire or wheel size or other differential variations without compromising the full power operation of either of the motors 90 or 96 in the event that the tires or wheels driven by the respective motors may be in slippery traction conditions and lose traction so that the remaining wheels located on a reasonable traction surface may receive full power from the respective hydraulic motor.

The control for the hydraulic pump means 104 consists of a foot pedal 140 pivoted to the frame portion 24 by means of a pivot pin 142 such that the pedal may move in a forward direction as indicated by an arrow 144 or in a reverse direction as indicated by an arrow 146.

Pivotally connected by means of a pin 148 is a control link 150 which is coupled by means of a pivot 152 to a lever 154 which is fixed to the wobble plate operating shaft 114.

An extension of the lever 154 carries a pivot means 156 to which a link 158 is connected; this link at its opposite end is connected to a pivot 160 in connection with a lever 168 which is fixed to the wobble plate control shaft 112.

Figures 10, 11:
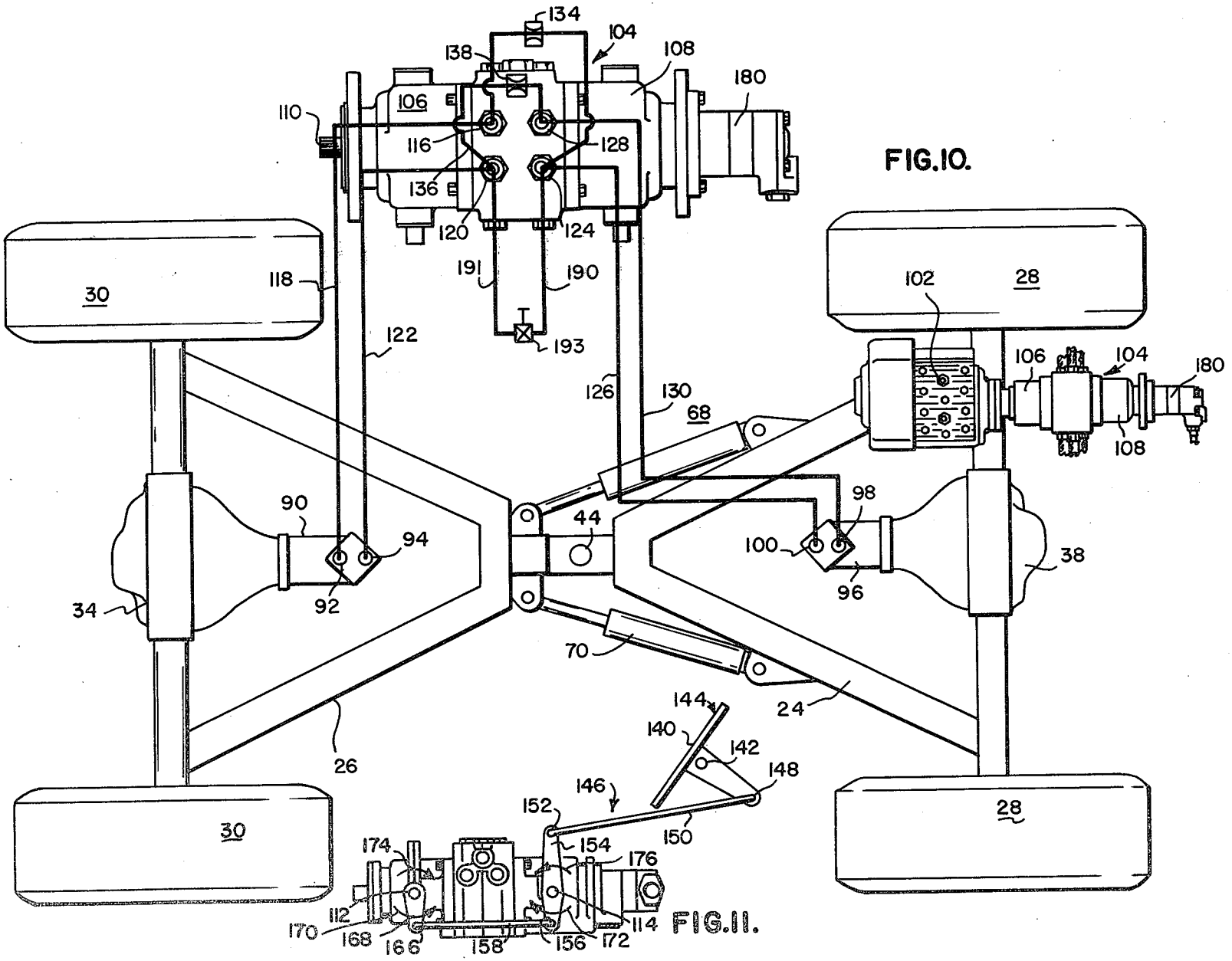
FIG. 10 is a diagramatic view showing the chasis and hydraulically powered drive train of the invention.
FIG. 11 is a view of the manual control for the variable output and reverseable hydraulic pumps which drive the hydraulic motors to power the front and rear wheels of the vehicle chasis.

Accordingly, when the foot pedal control is pivoted in the forward direction of the arrow 144, the wobble plate control shafts 112 and 114 are pivoted in the directions of the arrows 170 and 172 and when the control pedal 140 is moved in the direction of the arrow 146, which is the reverse direction, the wobble plate control shafts 112 and 114 are moved or pivoted in the directions of the arrows 174 and 176, all as shown best in FIG. 11 of the drawings. It will be understood that in a null position, neither hydraulic motor is energized to deliver fluid under pressure due to neutral position of the respective wo-ble plates controlled by the shafts 112 and 114, and when the pedal 140 is moved in the direction of the arrow 144, these reverseable variable delivery pumps 106 and 108 are energized to deliver hydraulic fluid under pressure through the conduits 118 and 126 at rates comparable to the degree to which the foot pedal 140 is moved in the direction of the arrow 144. Conversely, when the foot pedal is moved in the direction of the arrow 146, the reverse operation takes place and the pumps 106 and 108 reverse themselves causing reversal of the motors 90 and 96 and the differentials 34 and 38 respectively. The degree to which the pedal 140 is moved in the direction of the arrow 146 dictates the amount of hydraulic fluid delivered in gallons per minute and the relative speed of the vehicle is such direction.

Accordingly, the vehicle will move forward when the pedal 140 is moved in the forward direction of the arrow 144 and will move rearwardly when the foot pedal 140 is moved in the direction of the arrow 146.

Connected to the pumps means 140 is a separate hydraulic pump 180 which is adapted to supply hydraulic fluid under pressure to the cylinders 68 and 70 hereinbefore described, as well as any other hydraulic cylinder actuated mechanism of the vehicle.

As shown in FIGS. 1, 3, 4 and 5, the trash collecting vehicle of the invention is provided with a driver's compartment 182 at the forward portion 20 thereof and in this compartment is a seat 184, a steering wheel 186 and the foot control 140 hereinbefore described.

Adjacent to the driver's compartment 182 and at the front of the vehicle near the opposite side thereof is a container grasping and handling means 188, which is carried by an arm 190 having a horizontal pivot 192 moveable upward and downward on track means 194. The arm 190 is provided with arcuate elements 196 which are similar to quadrants of sprockets and these sprockets traverse roller chains 198 and a hydraulic cylinder 200 is provided with a plunger which forces the pivotal axis 192 upward and downward relative to the tracks 194. The container grasping means is provided with callipers 202 and 204 operated by a hydraulic cylinder 206. These callipers 202 and 204 are adapted to grasp opposite sides of a container 210 as shown in FIG. 3 of the drawings and move it from a horizontal position of the grasping mechanism 188, as shown in FIG. 2 of the drawings, to the elevated and upsidedown position shown in FIG. 3 of the drawings, which is above a trash receiver 212.

Accordingly, the highly maneuverable vehicle of the invention is readily and easily operable from the driver's compartment 182 by a person who can watch the opposed callipers 202 and 204 and actuate the hydraulic cylinder 206 by means of a suitable control valve so as to open and close the callipers relative to the container 210 and who may also operate the hydraulic cylinder 200 for moving the container into an elevated upsidedown position shown in FIG. 3 for dumping trash into the removable trash receiver 212. Each container is picked up at the level shown in FIG. 2 of the drawings while on the ground and while steering the vehicle about the vertical axis of the pin 44 which cooperates with the aforementioned hydraulic control system for rapid forward and reverse action coupled with the articulated steering to thereby render it possible for a person to quickly and accurately grasp containers between the callipers 202 and 204 and to elevate the container to a dumping position in upsidedown relationship to the receiver 212, as shown in FIG. 2 of the drawings.

As shown in FIG. 10 of the drawings, a conduit 191 communicates with the pressure fluid delivery conduit 124 of the pump 108 and also communicates with the fluid return conduit 120 of the pump 106 and an openable shut off valve 193 is adapted to close the conduit 191 for normal operation and to allow the conduit 191 to be opened to permit flow from the delivery conduit 124 to the return conduit 120 so that the vehicle may be towed due to the fact that free circulation of hydraulic fluid will be permitted through the system when the tow control valve 193 is opened.

It will be obvious to those skilled in the art that various modifications may be resorted to without departing from the spirit of the invention.

I claim:

1. A four wheel drive trash collecting and handling vehicle having: forward and rearward portions; a frame for said vehicle; a pair of front wheels connected to said frame and supporting said forward portion of said vehicle; a pair of rear wheels connected to said frame and supporting said rearward portions of said vehicle; said front wheels and said rear wheels both being pivotally steerable relative to each other; said frame comprising a front axle housing provided with a differential mechanism connecting said front wheels for driving the same and a rear axle housing provided with a differential mechanism connecting said rear wheels for driving the same; a first hydraulic motor for driving said differential of said front axle housing; a second hydraulic motor for driving said differential of said rear axle housing; an engine carried on said frame; a hydraulic pump means coupled to said engine; and said first and second motors being hydraulic motors coupled to said pump means to receive hydraulic fluid under pressure from said pump means; a driver's support and controls disposed at one side of said forward portion of said vehicle; a cab housing said driver's support and controls and having inner and outer sides; a container grasping and pickup means moveably mounted on said forward portion of said vehicle; actuating means on the end of an arm pivoted to said front portion at the inner side of said cab and projecting forwardly of said front portion, said pickup means including said arm; said actuating means disposed to move said container grasping means upwardly and backwardly toward said rearward portion of said vehicle; said actuating means being provided with means for moving said container grasping means so as to transfer a container from an upright position to a substantially upside-down position over said rearward portion of said vehicle; said rearward portion of said vehicle having supporting frame means for removably supporting a removable trash receiver in position to receive trash emptied from a container when moved upward and backward and upside-down by said container grasping and actuating means and further whereby said removable trash receiver is easily removed from said supporting frame means by lifting therefrom when said removable trash receiver is full.

2. The invention as defined in claim 1, wherein: said frame is also provided with a pivotal coupling between said forward and rearward portions; said pivotal coupling being disposed on a generally fore and aft horizontal axis to allow said front wheels and said rear wheels to adapt to relatively uneven surfaces over which said vehicle may be driven.

3. The invention as defined in claim 1, wherein: said hydraulic pump means comprises first and second reversable and variable delivery pumps; each pump having fluid pressure outlet and return conduits; said first and second hydraulic motors each having fluid pressur einlet and return conduits coupled to respective fluid pressure outlet and return conduits of said first and second pumps.

4. The invention as defined in claim 3, wherein: said first and second pumps having first and second operating means for varying volumetric delivery of hydraulic fluid under pressure and said first and second operating means also adapted to reverse delivery and return of hydraulic fluid through said delivery and return conduits of said first and second pumps respectively; and connection means coupling said first and second operating means; and a manual control member coupled to said connection means and operable to move in one direction to variably increase volumetric delivery of liquid from said pumps in a forward direction; said manual control member moveable in an opposite direction to variably increase volumetric delivery of liquid from said pumps in a reverse direction.

5. The invention as defined in claim 1, wherein: said forward and rearward portions of said frame are pivoted together about a generally vertical axis; control operated means for flexing said frame about said vertical axis to cause relative steering action of said front and rear wheels.

6. The invention as defined in claim 5, wherein: said control operated means comprises a hydraulic cylinder having a plunger; said cylinder pivotally coupled to one of said portions of said frame; said plunger pivotally connected to the other of said portions of said frame.

7. The invention as defined in claim 2, wherein: said forward and rearward portions of said frame are pivoted together about a generally vertical axis; control operated means for flexing said frame about said vertical axis to cause relative steering action of said front and rear wheels.

8. The invention as defined in claim 7, wherein: said control operated means comprises a hydraulic cylinder having a plunger; said cylinder pivotally coupled to one of said portions of said frame; said plunger pivotally connected to the other of said portions of said frame.

9. The invention as defined in claim 8, wherein: said hydraulic pump means comprises first and second reversable and variable delivery pumps; each pump having fluid pressure outlet and return conduits; said first and second hydraulic motors each having fluid pressure inlet and return conduits coupled to respective fluid pressure outlet and return conduits of said first and second pumps; said first and second pumps having first and second operating means for varying volumetric delivery of hydraulic fluid under pressure therefrom; and said first and second operating means also adapted to reverse delivery and return of hydraulic fluid through said delivery and return conduits of said first and second pumps respectively; and connection means coupling said first and second operating means; and a manual control member coupled to said connection means and operable to move in one direction to variably increase volumetric delivery of liquid from said pumps in a forward direction; said manual control member moveable in an opposite direction to variably increase volumetric delivery of liquid from said pumps in a reverse direction.

10. The invention as defined in claim 3, wherein: a first bleed flow conduit means coupling said return conduit of said first pump with the return conduit communicating with said second pump; and a second bleed flow conduit means coupling said pressure delivery conduit of said first pump with the pressure delivery conduit communicating with said second pump whereby the aggregate of the peripheries of the front wheels driven by the respective differential may vary slightly relative to the aggregate of the peripheries of the rear wheels driven by the respective differential without creating a traction difference between said front and rear wheels; said bleed flow conduits being restricted so as to allow nominal bleed flow of fluid therethrough such that the loss of hydraulic volume delivery to said motors may be very nominal relative to the maximum hydraulic delivery capacity of said pump means whereby said bleed flow conduits only serve to compensate for slight differences in wheel or tire size without unduly compromising maximum hydraulic power output performance of either of said hydraulic motors when the wheels driven by one of them slip.

11. The invention as defined in claim 3, wherein: a tow control conduit interconnects the delivery conduit communicating with one of said pumps and the return conduit communicating with the other of said pumps; and an openable shut off valve in said tow control conduit whereby, when said shut off valve is open, said vehicle may be towed due to free circulation of liquid therethrough from said last mentioned delivery conduit to said last mentioned return conduit.

12. A trash collecting and handling vehicle having: forward and rearward portions; a chassis for said vehicle; a pair of front wheels connected to said chassis and supporting said forward portion of said vehicle; a pair of rear wheels connected to said chassis and supporting said rearward portions of said vehicle; a pair of said wheels being pivotally steerable relative to the other pair of said wheels; said chassis comprising an axle housing provided with a differential mechanism connecting a pair of said wheels for driving the same; a hydraulic motor for driving said differential and said respective pair of wheels; an engine carried on said frame; a hydraulic pump means coupled to said engine; and said motor being a hydraulic motor coupled to said pump means to receive hydraulic fluid under pressure from said pump means; a driver's support and controls disposed at said forward portion of said vehicle at one side thereof; a cab housing said driver's support and controls and having inner and outer sides; a container grasping and pickup means moveably mounted on said forward portion of said vehicle; actuating means for said pickup means; said actuating means disposed to move said container grasping means upwardly and backwardly toward said rearward portion of said vehicle; said actuating means being provided with means on the end of an arm pivoted to said front portion at the inner side of said cab and projecting forwardly of said front part for moving said container grasping means so as to transfer a container from an upright position to a substantially upsidedown position over said rearward portion of said vehicle; said rearward portion of said vehicle having supporting frame means for removably supporting a removable trash receiver in position to receive trash emptied from a container when moved upward and backward and upsidedown by said container grasping and actuating means; said hydraulic pump means comprising a reverseable and variable delivery pump having a fluid pressure outlet and a fluid return conduit; said hydraulic motor having a fluid pressure inlet and return conduit coupled respectively to the fluid pressure outlet and return conduit of said pump said pump having means for varying volumetric delivery of hydraulic fluid under pressure; and a manual control member coupled to said operating means and operable to move in one direction to variably increase volumetric delivery of liquid from said pump in a forward direction; said manual control member moveable in an opposite direction to variably increase volumetric delivery of liquid from said pump in a reverse direction and further whereby said removable trash receiver is easily removed from said supporting frame means by lifting therefrom when said removable trash receiver is full.

13. The invention as defined in claim 12, wherein: said forward and rearward portions of said frame are pivoted together about a generally vertical axis; control operated means for flexing said frame about said vertical axis to cause relative steering action of said front and rear wheels.

14. The invention as defined in claim 13, wherein: said control operated means comprising a hydraulic cylinder having a plunger; said cylinder pivotally coupled to one of said portions of said frame; said plunger pivotally connected to the other of said portions of said frame.

15. The invention as defined in claim 12, wherein: said hydraulic pump comprises reverseable and variable delivery pump means; said pump means having a fluid pressure oulet and a fluid return conduit; said motor having a fluid pressure inlet and a return conduit coupled to respective fluid pressure outlet and return conduits of said pump means; said pump means having operating means for varying volumetric delivery of hydraulic fluid under pressure therefrom; a manual control member coupled to said pump means and operable in one direction to variably increase volumetric delivery of liquid from said pump in a forward direction; said manual control moveable in an opposite direction to variably increase volumetric delivery of liquid from said pump in a reverse direction.

* * * * *